US005651145A

United States Patent [19]

Egger

[11] Patent Number: 5,651,145

[45] **Date of Patent: *Jul. 29, 1997**

[54] BICYCLE HELMET

[75] Inventor: F. Robert Egger, Watsonville, Calif.

[73] Assignee: Specialized Bicycle Components, Inc., Morgan Hill, Calif.

[ * ] Notice: The term of this patent shall not extend beyond the expiration date of Pat. No. 5,450,631.

[21] Appl. No.: 526,451

[22] Filed: Sep. 11, 1995

Related U.S. Application Data

[63] Continuation of Ser. No. 123,728, Sep. 17, 1993, Pat. No. 5,450,631 .

[51] Int. Cl.[6] ..... A42B 1/06

[52] U.S. Cl. ..... 2/425; 2/411; 2/171.3

[58] Field of Search ..... 2/410, 411, 414, 2/421, 422, 424, 425, 171.3

[56] References Cited

U.S. PATENT DOCUMENTS

| | | | |
|---|---|---|---|
| D. 212,667 | 11/1968 | Vanderbilt | D2/231 |
| D. 272,769 | 2/1984 | Sundahl et al. | D2/231 |
| D. 285,980 | 10/1986 | McNabb | 2/410 |
| D. 293,496 | 12/1987 | Gentes | D29/12 |
| D. 297,067 | 8/1988 | Schonwetter et al. | D2/260 |
| D. 299,180 | 1/1989 | Gentes | D2/260 |
| D. 309,961 | 8/1990 | Bobrick | D29/12 |
| D. 310,893 | 9/1990 | Broersma | D29/12 |

(List continued on next page.)

FOREIGN PATENT DOCUMENTS

| | | | |
|---|---|---|---|
| 0 096 148 | 12/1983 | European Pat. Off. . | |
| 497032 | 8/1992 | European Pat. Off. | 2/411 |
| WO89/01744 | 3/1989 | WIPO . | |

OTHER PUBLICATIONS

*American Bicyclist & Motorcyclist*, Mar. 1985, pp. 34, 46, 47, 49 and 51–57.

*Bicycling*, Mar. 1990, p. 57, depicting the "Trek USA" helmet.

Product Brochure by Echelon Sports Corporation (1989), depicting the "Look" helmet.

Product Brochure by Innova–Dex Sports, Inc. (1989), depicting the "Gara" cycling helmet.

Photocopies of photographs of Giro Prolight™ helmet, (3 pages total).

Product Brochure by Aria Sonics (1989), depicting the "Tempest" helmet.

*Bicycling*, Jun. 1991, p. 63, depicting the "Air Force™ II" helmet by Specialized Bicycle Components.

Product Brochure by Innova–Dex Sports, Inc. (1989), depicting the "Avanti" helmet.

*Bicycling*, Oct. 1991, p. 81, depicting the "Louis Garneau" helmet.

*Bicycling*, Feb. 1992, p. 25, depicting the "Louis Garneau" helmet.

*Bicycling*, Feb. 1992, p. 29, depicting the "Hammerhead SC™" helmet by Giro.

*Bicycling*, Jul. 1988, p. 89, depicting "Vetta Helmets".

*Bicycling*, Jul. 1988, p. 119, depicting "Giant AT–750 Helmets".

*Primary Examiner*—Michael A. Neas

*Attorney, Agent, or Firm*—Burns, Doane, Swecker & Mathis, L.L.P.

[57] ABSTRACT

A bicycle helmet includes a helmet body having a plurality of vents, including a front vent that is wider than high. Also, a bicycle helmet includes a helmet body having a plurality of vents, including at least one rear exit port opening outward onto a surface that is below the most rearward margin of the helmet body. Preferred helmets include both such a front vent and a pair of such rear exit ports, and preferred helmets include at least one and more preferably two lengthwise interior channels that may conduct air rearwardly within the helmet over the head of the wearer from the front vent or to the rear exit port or ports, or both from the anterior vent and to the rear exit port or ports. Methods for fabricating a helmet according to the invention include forming the helmet body of two separate parts and affixing the two formed parts together.

10 Claims, 9 Drawing Sheets

U.S. PATENT DOCUMENTS

| | | | |
|---|---|---|---|
| D. 316,165 | 4/1991 | Gentes et al. | D29/12 |
| D. 319,112 | 8/1991 | Broersma | D29/12 |
| 1,880,819 | 10/1932 | Collins . | |
| 2,081,335 | 5/1937 | Levinson . | |
| 2,344,927 | 3/1944 | Weikert . | |
| 2,677,457 | 5/1954 | Guest . | |
| 2,734,197 | 2/1956 | Kreinik | 2/187 |
| 3,015,104 | 1/1962 | Crosson et al. | 2/6 |
| 3,105,240 | 10/1963 | Jansson . | |
| 3,155,981 | 11/1964 | McKissick et al. | 2/422 |
| 3,166,766 | 1/1965 | Banello | 2/187 |
| 3,582,990 | 6/1971 | Frieder | 2/6 |
| 3,783,450 | 1/1974 | O'Connor | 2/425 |
| 3,925,821 | 12/1975 | Lewicki | 2/171.3 |
| 4,044,400 | 8/1977 | Lewicki et al. | 2/421 |
| 4,075,714 | 2/1978 | Ryder et al. . | |
| 4,075,715 | 2/1978 | Cowgill | 2/6 |
| 4,115,874 | 9/1978 | Hasegawa | 2/425 |
| 4,404,690 | 9/1983 | Farquharson . | |
| 4,434,514 | 3/1984 | Sundahl et al. | 2/425 |
| 4,443,891 | 4/1984 | Blomgren et al. | 2/414 |
| 4,461,044 | 7/1984 | Reiterman et al. | 2/421 |
| 4,519,099 | 5/1985 | Kamiya et al. | 2/425 |
| 4,555,816 | 12/1985 | Broersma | 2/425 |
| 4,599,752 | 7/1986 | Mitchell | 2/425 |
| 4,622,700 | 11/1986 | Sundahl | 2/425 |
| 4,653,123 | 3/1987 | Broersma | 2/425 |
| 4,700,411 | 10/1987 | Kawasaki et al. | 2/425 |
| 4,901,373 | 2/1990 | Broersma | 2/421 |
| 4,903,348 | 2/1990 | Broersma | 2/421 |
| 4,903,350 | 2/1990 | Gentes et al. | 2/421 |
| 4,993,082 | 2/1991 | Gentes et al. | 2/410 |
| 4,996,724 | 3/1991 | Dextrase | 2/411 |
| 5,023,958 | 6/1991 | Rotzin | 2/411 |
| 5,083,321 | 1/1992 | Davidsson . | |
| 5,088,130 | 2/1992 | Chiarella | 2/411 |
| 5,093,936 | 3/1992 | Copeland et al. . | |
| 5,099,523 | 3/1992 | Broersma | 2/411 |
| 5,119,516 | 6/1992 | Broersma | 2/411 |
| 5,123,121 | 6/1992 | Broersma . | |
| 5,381,560 | 1/1995 | Halstead . | |
| 5,448,780 | 9/1995 | Gath . | |
| 5,450,631 | 9/1995 | Egger | 2/425 |

BICYCLE HELMET

This application is a continuation of application Ser. No. 08/123,728, filed Sep. 17, 1993 now U.S. Pat. No. 5,450,631.

BACKGROUND OF THE DISCLOSURE

1. Technical Field

This invention relates to protective headgear for use by bicyclists.

2. Background Art

Some form of protective headgear has become generally recognized as an important part of the bicyclist's equipment, whether for recreational or more serious use. Considerable resources have been expended in efforts better to understand head injury relating to bicycle use, to develop headgear that can provide improved safety in the event of an impact to the bicyclist's head.

With acceptance of protective headgear by bicyclists has come a demand, particularly from competitive bicyclists, for improvements in bicycle helmets. Not only must a helmet provide adequate protection from serious head injury; desirably the helmet additionally is lightweight and aerodynamically configured for reduced wind resistance, and is minimally uncomfortable or confining. Particularly, bicycle helmets characteristically are provided with openings so that portions of the wearer's head are exposed to ambient air, and in some instances these openings are configured to promote air movement over the wearer's head. As will be appreciated, ventilation of the helmet by providing openings can result in a compromise of the structural integrity of the resulting helmet, which can in turn reduce the effectiveness of the helmet for head protection.

SUMMARY OF THE INVENTION

We have discovered that a bicycle helmet having an appropriately configured and suitably located front intake vent or an appropriately configured and situated rear exit port or exit ports, or both such a front vent and a rear port or ports, can provide for improved movement of air over the wearer's head while retaining sufficient structural integrity to provide adequate head protection.

DISCLOSURE OF THE INVENTION

In one general aspect the invention features a bicycle helmet that includes a helmet body having a plurality of vents, including a front vent that is wider than high.

In another general aspect, the invention features a bicycle helmet that includes a helmet body having a plurality of vents, including at least one rear exit port opening outward onto a surface that is below the most rearward margin of the helmet body.

DESCRIPTION OF PREFERRED EMBODIMENTS

Preferred embodiments of the invention will now be described, beginning with a brief description of the drawings. The drawings are meant to be representational; they are not necessarily made exactly to scale, and certain lengths or distances in the drawings may be exaggerated for clarity. A part that appears in more than one drawing is in many instances identified by the same reference numeral throughout the drawings, to facilitate cross-reference among the various views represented in the Figs.; but in some of the Figs., for improved clarity of presentation, not all the parts that appear in the Fig. are identified by their respective numerals.

MODES OF CARRYING OUT THE INVENTION

Structure

Referring now to FIGS. 1–6, there is shown generally at 2 an exemplary helmet body according to the invention. Helmet body 2 consists of an upper crown portion 4, which in use rests upon and generally covers the upper portion of the wearer's head, and a skirt portion 6, which extends downward to some extent over the sides and the rear of the wearer's head.

As will appear from the Figs. and as is explained more fully below, the helmet body is vented and shaped to provide improved movement of air over the head. Particularly, the helmet according to the invention has a front vent 10, dimensioned and shaped to provide for flow of oncoming air onto and over the wearer's forehead. Front vent 10 preferably is situated as close to the front margin of the helmet body as may be structurally permissible, and preferably it is generally wider than high.

Figure 1:
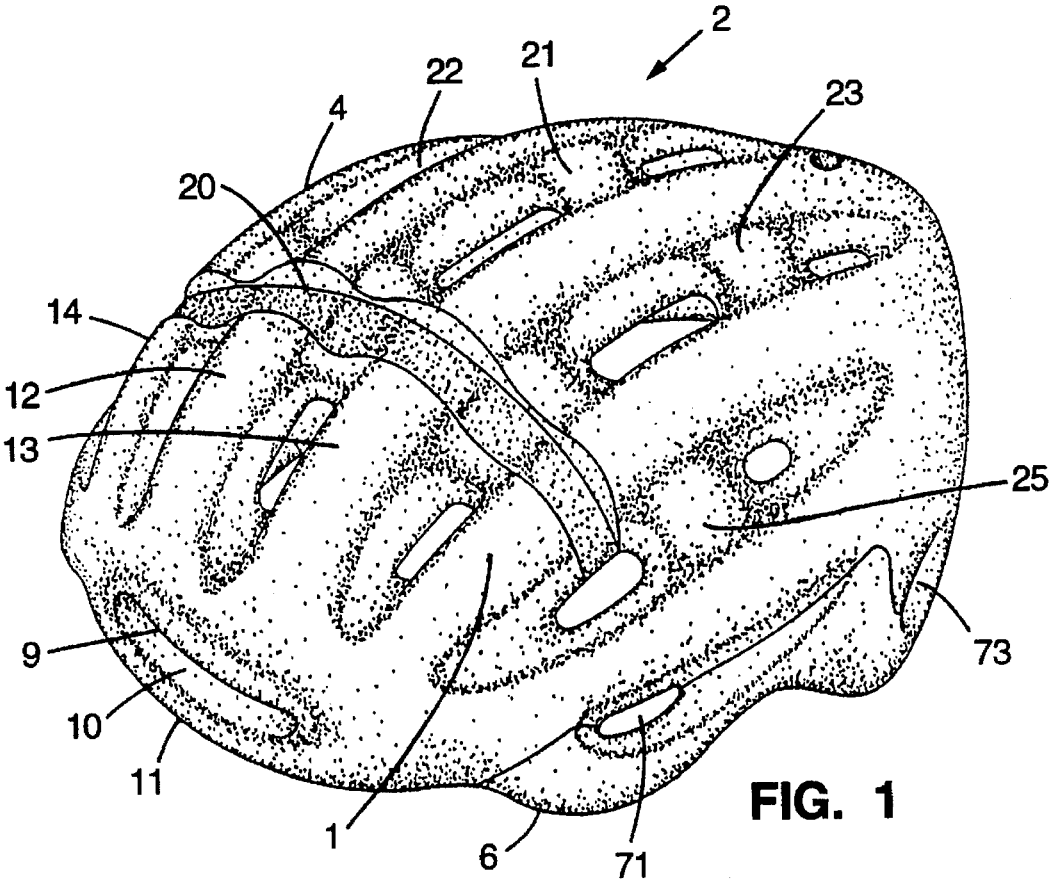
FIG. 1 is a sketch showing an embodiment of the invention in perspective view.
Figure 2:
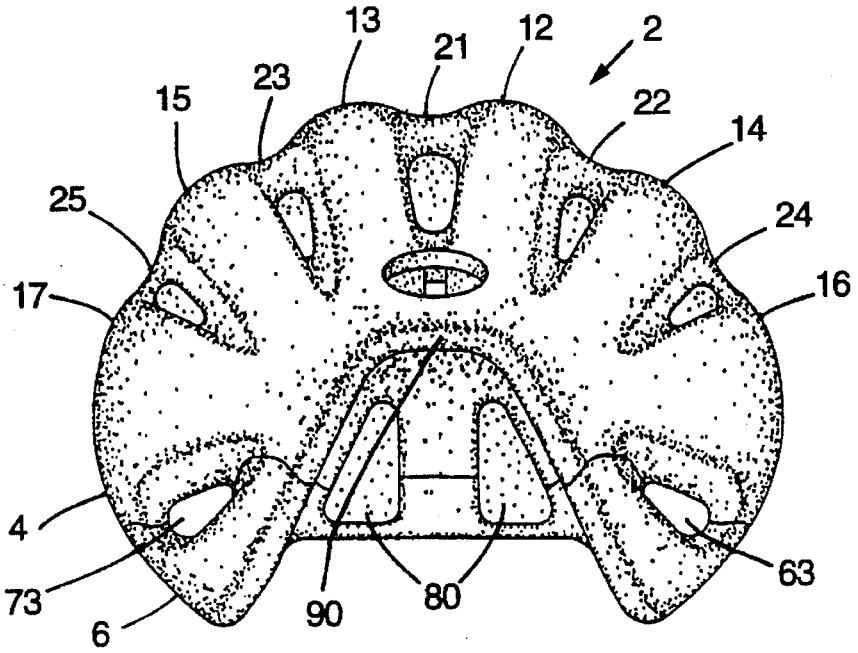
FIG. 2 is a sketch showing the embodiment of FIG. 1 in a front view.

In some preferred embodiments the helmet according to the invention is provided with a rear vent at the midline or, as shown for example in FIG. 2, more preferably with a pair of rear exit ports 80 situated close to the midline. The rear exit port or rear exit ports 80 are configured such that air moves from within the helmet rearward and outward through the rear ports 80 as the wearer's head moves forward. Preferably, the rear port or rear port 80 open beneath that part of the helmet that is most rearward, as shown for example at 90 in FIGS. 2 and 3.

In preferred embodiments the helmet is provided with vents over the top of the crown in addition to front vent 10 and/or rear port or ports 80. Preferably such top vents are arranged in lengthwise rows and include in each row at least a more forward vent and a more rearward vent; in this configuration the more forward vent in each series can be configured to provide for flow of oncoming air onto and over the wearer's head. The number and size of the top vents can, without unduly compromising the strength of the helmet, be increased by constructing the crown portion of the helmet as a series of ridges, and situating the top vents in the valleys formed between them.

Figure 3:
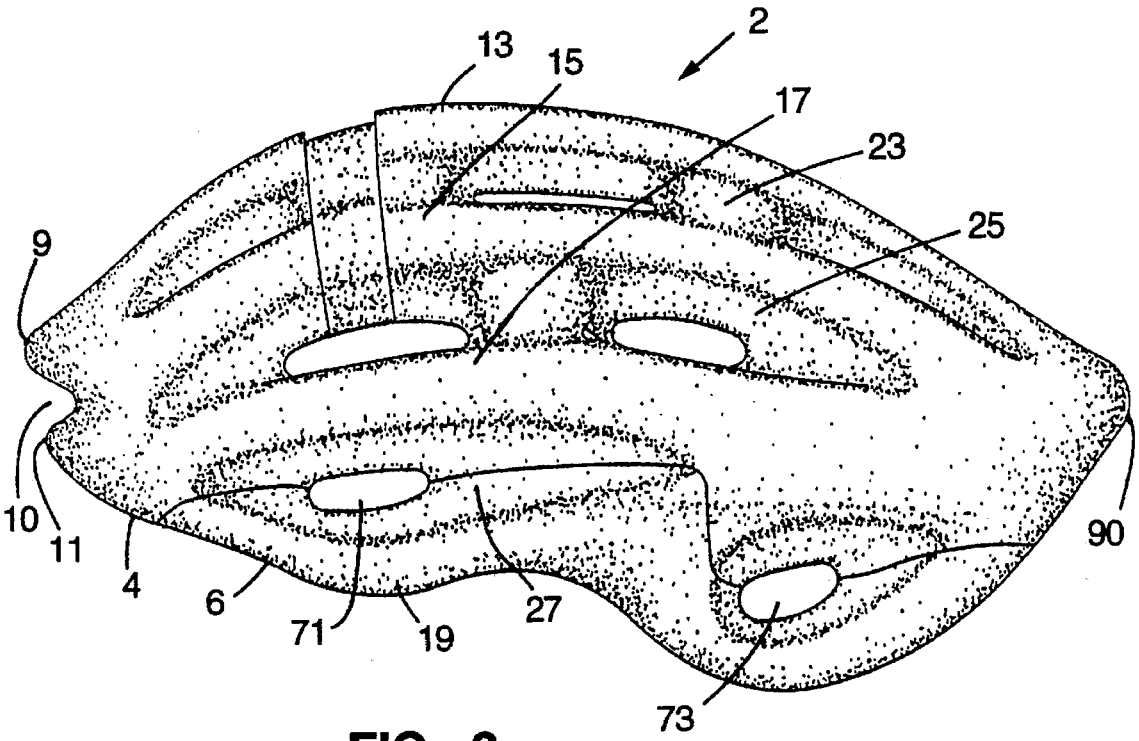
FIG. 3 is a sketch showing the embodiment of FIG. 1 in a left side view.
Figure 4:
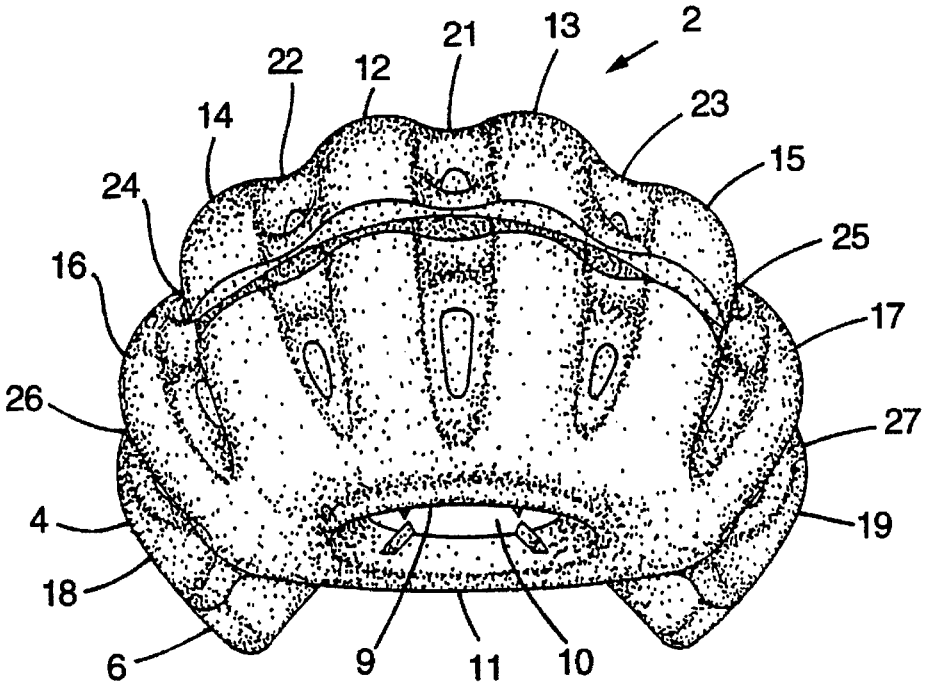
FIG. 4 is a sketch showing the embodiment of FIG. 1 in a rear view.
Figure 5:
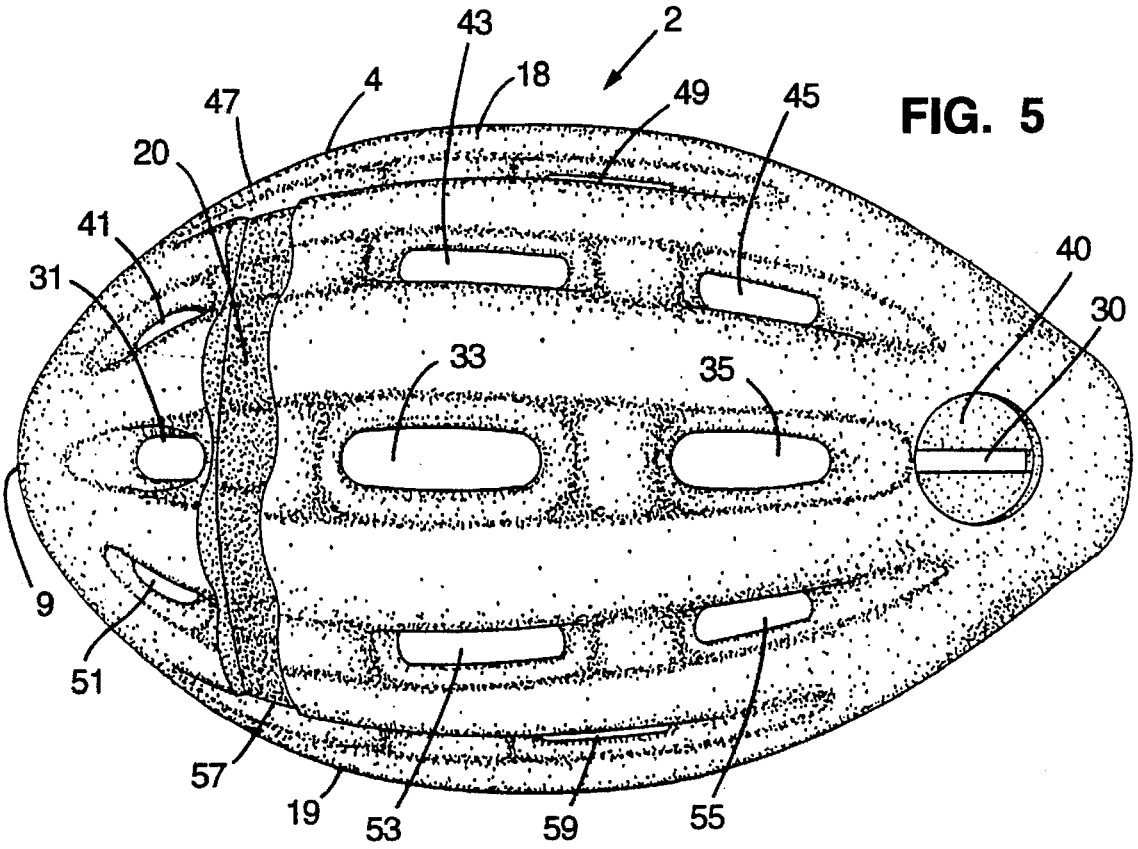
FIG. 5 is a sketch showing the embodiment of FIG. 1 viewed from above.

A preferred configuration is shown for example in the Figs.; the ridge-and-valley configuration is particularly clearly shown in FIGS. 2 and 4, while the arrangement of vents is shown particularly clearly in FIGS. 3 and 5. First paired longitudinal ridges 12, 13, second paired longitudinal ridges 14, 15, and third paired longitudinal ridges 16, 17 are separated by midline valley 21, and first and second paired valleys 22, 23, 24, and 25. Third shorter paired skirt valleys 26, 27 are formed in skirt portion 6 between paired longitudinal ridges 16, 17, and paired side skirt ridges 18, 19, respectively.

A series of three midline vents 31, 33, 35 are arranged serially in midline valley 21; two series of three vents 41, 43, 45, and 51, 53, 55, are arranged serially in first paired valleys 22, 23, respectively; and two pairs of vents 47, 49, and 57, 59, are arranged in second paired valleys 24, 25, respectively; vents 61, 71 are situated in paired skirt valleys 26, 27, respectively; and vents 63, 73 are situated to rearward, above and behind the wearer's ear, in depressions in the skirt portion 6.

Preferably, greater strength is obtained by making each valley shallower between the vents, that is, by providing some considerable thickness of the helmet body material between the vents. As will appear from the Figs., forward vents 31, 41, 51 generally open more frontwardly, while rearward vents 35, 45, 55 generally open more rearwardly.

Air movement over the head within the helmet preferably is directed by one or more channels formed in lengthwise orientation on the interior of the crown portion; the channel or channels are most preferably aligned with one or more series of vents. In the preferred configuration shown in FIG. 6, for example, three channels 91, 92, 93 in the interior of the crown portion of the helmet body are aligned with vents series 31, 33, 35, and 41, 43, 45, and 51, 53, 55, respectively. Most particularly in this configuration, the paired lateral channels 91, 92 are forwardly generally aligned with the inner lateral limits of front intake vent 10, and are rearwardly generally aligned with the inner upper limits of paired rear exit ports 80. This configuration of interior channels can facilitate air movement in the airspace between the wearer's head and the helmet as follows. Oncoming air enters the front intake vent 10, and flows onto and over the wearer's forehead, and channels 91 and, particularly, 92 and 93 help carry a portion of the air from the front vent 10 rapidly and directly rearward toward rear exit ports 80, through which air flows out and away behind the wearer.

As will be appreciated, not all the air that enters the interior of the helmet by way of the front intake vent 10 is expected to follow the path described above; nor is all the air that follows the channels or that exits the helmet by way of the rear exit port or exit ports 80 expected to have entered the helmet by way of the front intake vent 10. Particularly, and even if the front vent 10 were absent or were fully or partially blocked, rear exit port or exit ports 80 could contribute to an outflow of air that entered the helmet by way of other vents. And, where interior channels in the crown portion of the helmet body are rearwardly directed to the rear exit port or exit ports 80, the latter could contribute to flow of air over the wearer's head by way of any of the series of vents, and particularly by way of those vents that are aligned with the interior channels.

Figure 6:
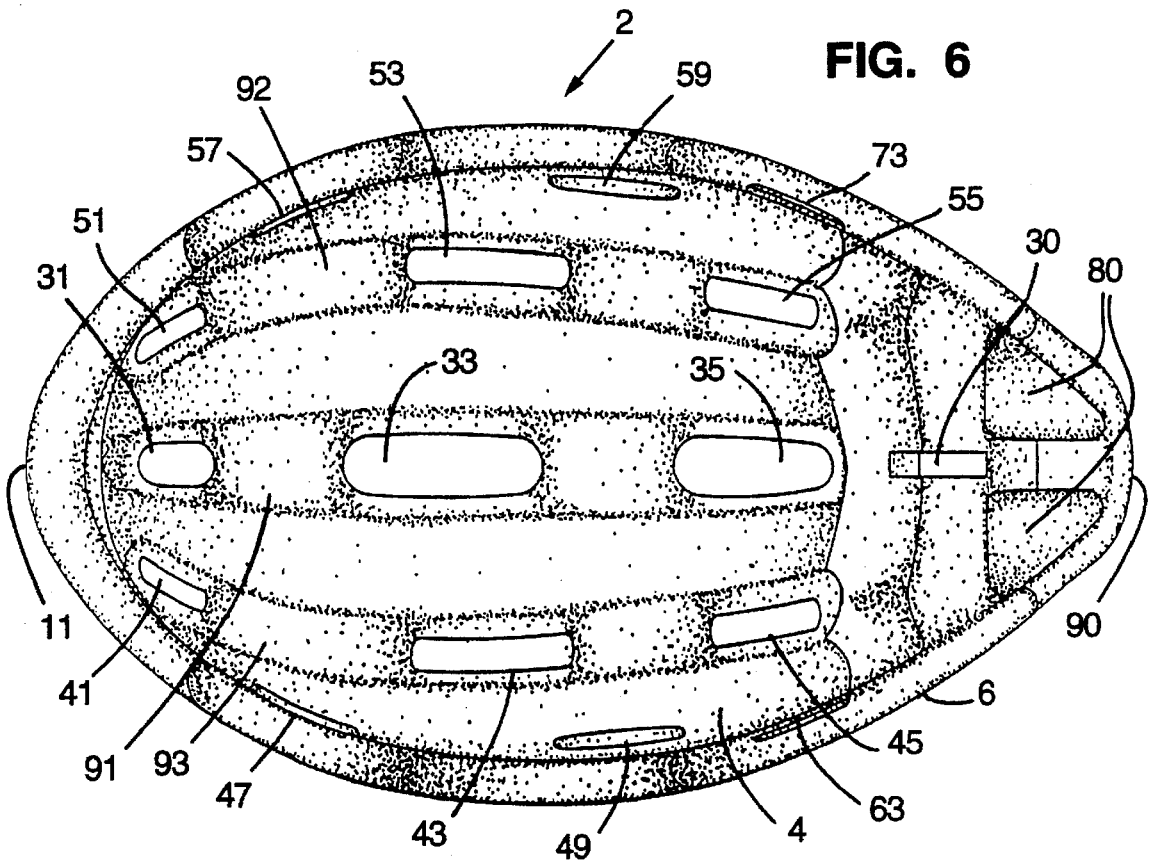
FIG. 6 is a sketch showing the embodiment of FIG. 1 viewed from below.
Figure 7:
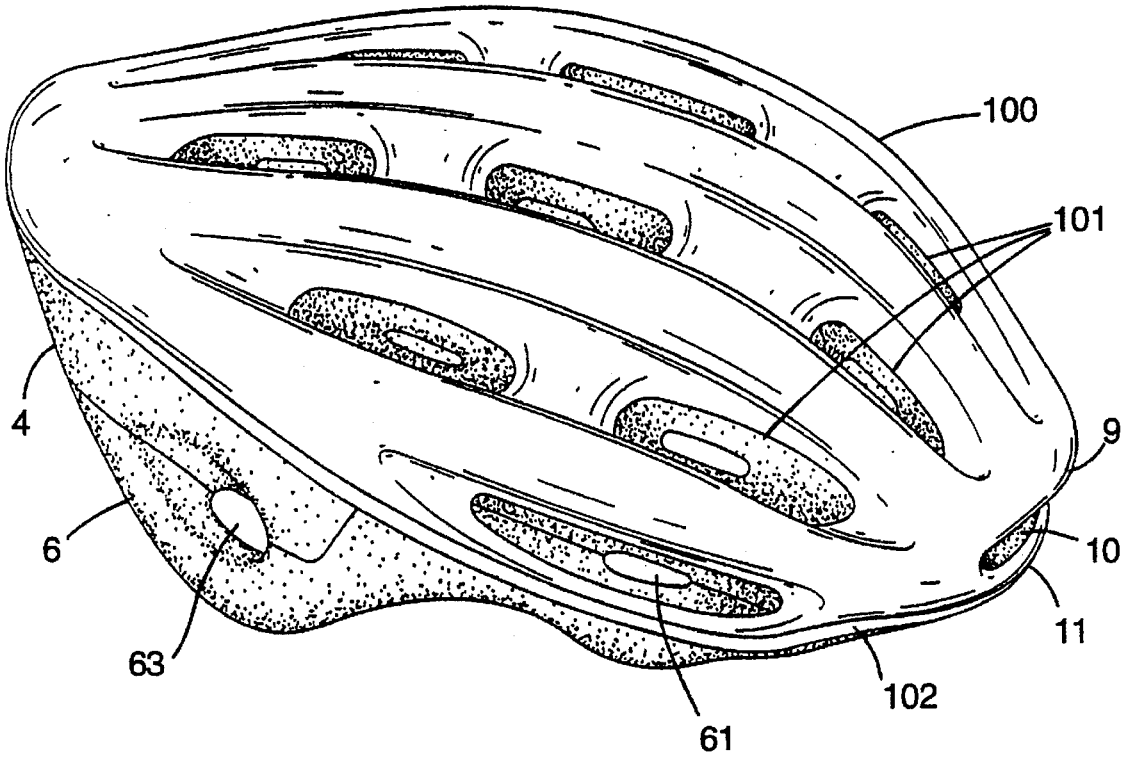
FIG. 7 is a sketch showing a second embodiment of the invention in perspective view.
Figure 8:
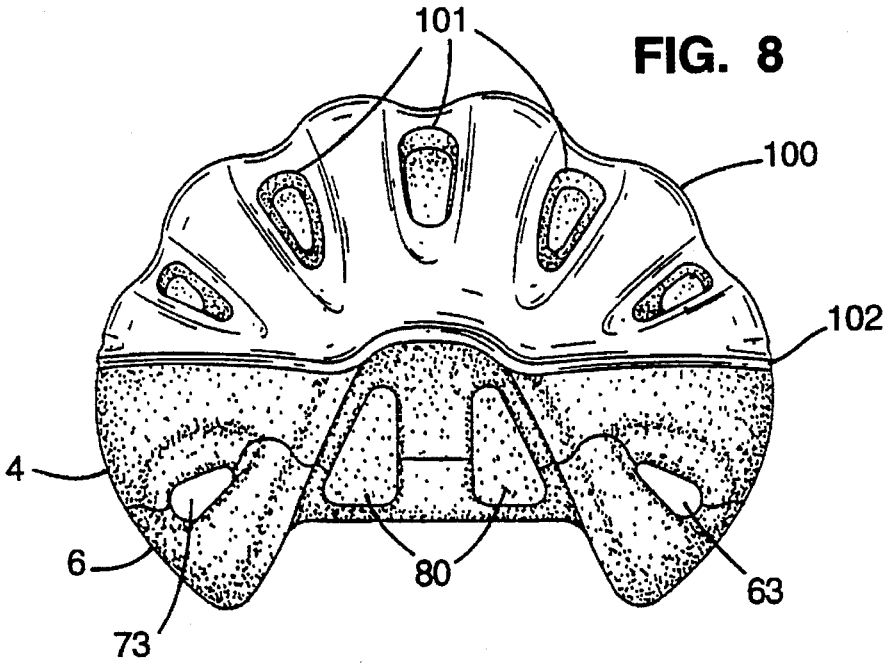
FIG. 8 is a sketch showing the embodiment of FIG. 7 in a front view.
Figure 9:
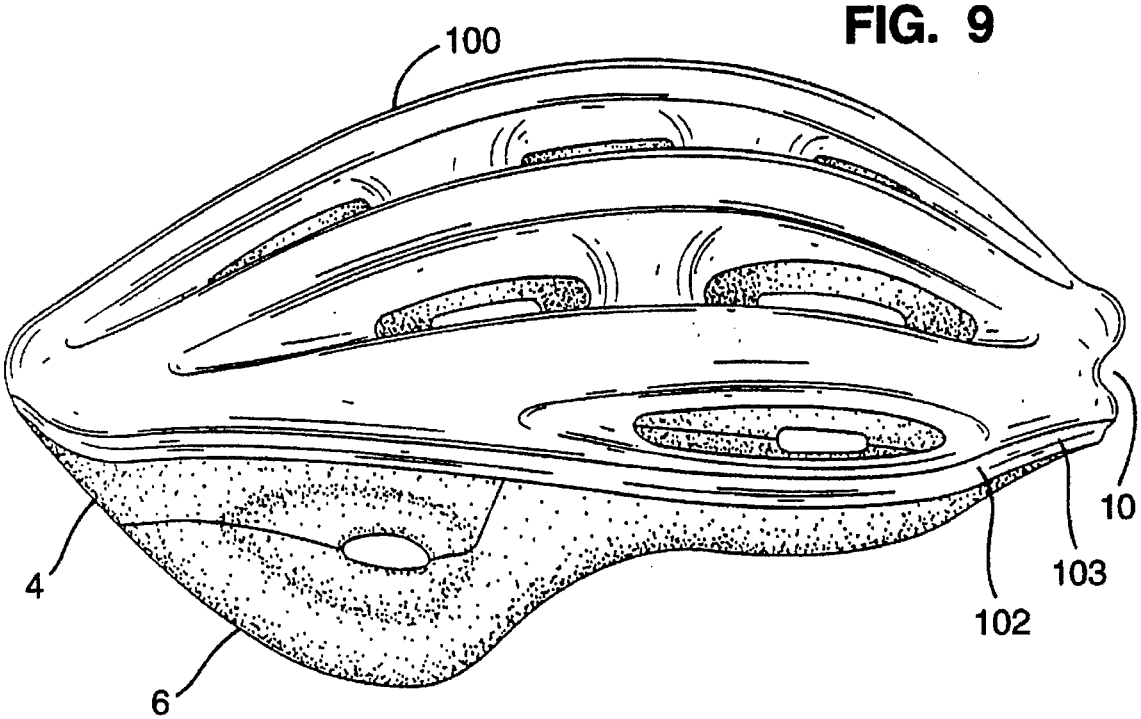
FIG. 9 is a sketch showing the embodiment of FIG. 7 in a right side view.
Figure 10:
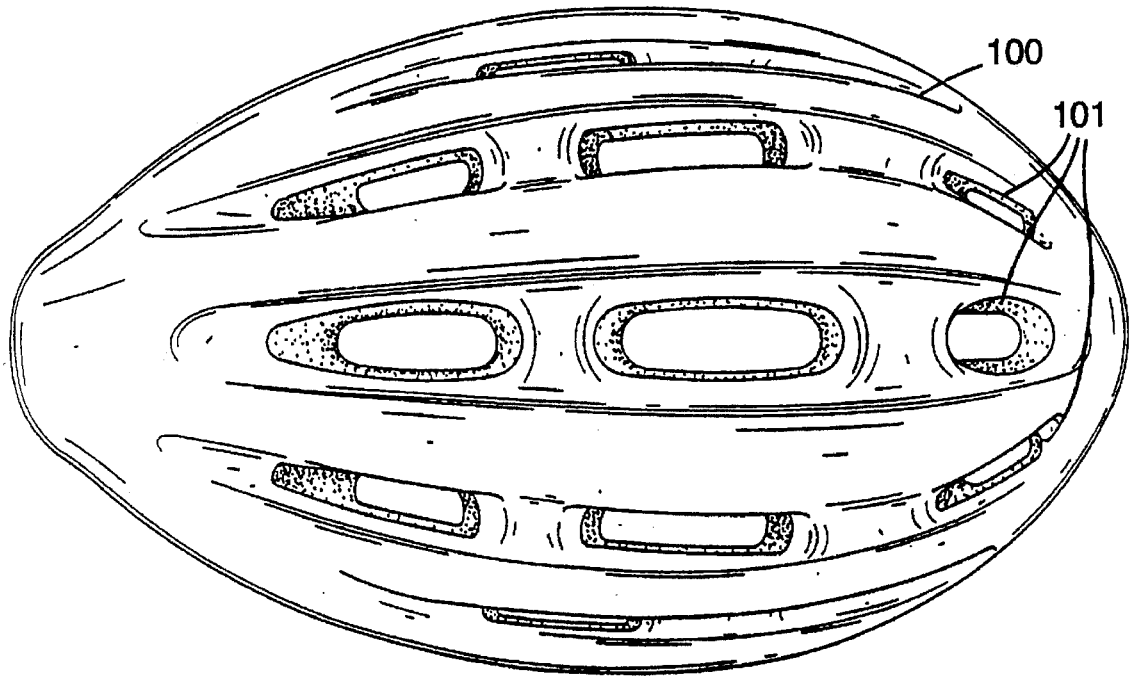
FIG. 10 is a sketch showing the embodiment of FIG. 7 in a rear view.
Figure 11:
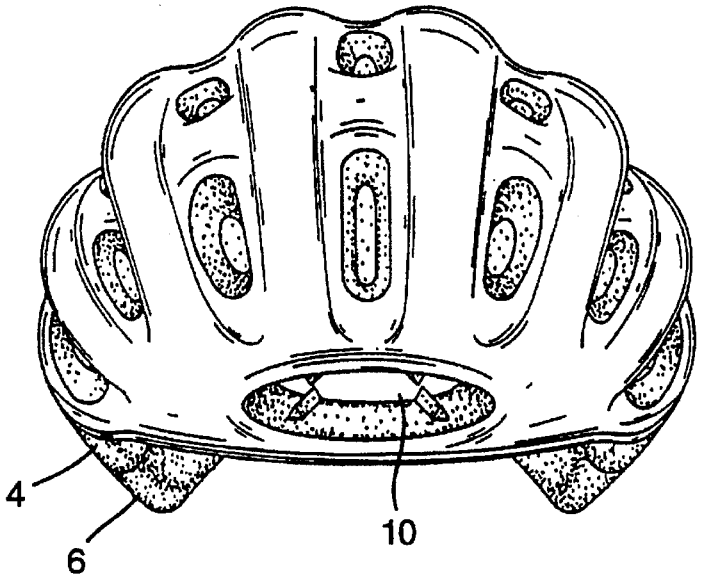
FIG. 11 is a sketch showing the embodiment of FIG. 7 viewed from above.

The capacity of the helmet for head protection is enhanced by securely fastening it to the wearer's head so that it stays in place upon impact. The helmet is preferably held in place by an adjustable arrangement of straps that pass down from the helmet body in front of and behind the ear on each side of the head, and that meet in front of and beneath the wearer's ears and pass around the chin. Such strap arrangements are generally known in the art, and are subject to variation and improvement. The helmet body of preferred embodiments of the invention is provided with a transverse groove over which the front strap passes, and with a slot at the midline toward the rear into which the rear strap is inserted and anchored. With reference now particularly to FIGS. 1, 3, 4, and 5, transverse groove 20 passes over the top of helmet body crown portion 4 from vent 57 in valley 25 to vent 47 in valley 24. Groove 20 traverses ridges 12, 13, 14, 15 across shallower portions of valleys 21, 22, 23 behind forward vents 31, 41, 51. The front strap (not shown in the Figs.) passes from below and within the helmet body up and out through vent 57, across the top of the helmet body in groove 20, and down and into the helmet body through vent 47. With reference particularly to FIGS. 2, 5, and 6, slot 20 passes generally upwardly through a rearward portion of the helmet body. A disc-shaped impression 40 in the upper surface of the helmet body at the point where slot 20 emerges accommodates an anchor over which the rear strap passes (neither the anchor nor the strap is shown in the Figs.). The rear strap passes from its junction below the helmet body with the front strap on the left side, up through slot 20 and over the anchor and back down through slot 20 to its junction below the helmet body with the front strap on the right side.

The helmet body as described with reference to FIGS. 1–6 can be constructed of any firm, lightweight material. Preferred materials include gas-expandable synthetic polymers formed using molding techniques generally known in the art. Particular methods are described in detail below.

A further embodiment is shown in FIGS. 7–12, which present a helmet according to the invention having a configuration similar to that shown in the embodiment of FIGS. 1–6. Many features that appear in FIGS. 7–12 are also shown in FIGS. 1–6, and are described with reference thereto; most of those common features are not additionally identified in FIGS. 7–12 or in the description that follows, but they can be understood by reference to the preceding discussion.

In this embodiment a helmet body constructed for example of an expanded synthetic polymer and configured as described above is partially covered by a thin shell of a harder polymeric material shaped and cut to conform to the outer surface of at least part of the crown portion of the helmet body. This embodiment may be even more preferred than that described above, as the thin shell can help to stabilize the structure of the expanded polymer body under impact, and improve the protective value of the helmet.

With reference now to FIGS. 7–12, thin shell 100 is shaped to conform to the contours of the outer surface of the crown portion 4 of helmet body 2, described above. Preferably, the portions of shell 100 that conform to valleys 21, 22, 23, 24 are cut (for example as indicated at 101) so that they reach to some extent down the valley walls into the vents in the valleys. And, preferably, the peripheral margin 102 of shell 100 is cut so that generally it traces the largest perimeter of the helmet body. That is, when viewed from above (see, for example, FIG. 10), the helmet body crown portion 4 appears to be completely covered by shell 100; and, when viewed from below (see, for example, FIG. 12), practically no part of shell 100 can be seen except, perhaps, the peripheral edge. Preferably, however, a peripheral part of shell 100 passes beneath, and to some extent into the lower wall of, front intake vent 10 as well as around and into other portions of front intake vent 10; and where, as may be desirable, the upper front margin 9 of front intake vent 10 extends farther forward than the lower from margin 11, the upper margin will of course appear in a view from below.

Shell 100 may be affixed to helmet body 2 by any convenient means. The shell and body may for example be bonded together by an adhesive, such as a contact adhesive, over much of the apposed surfaces of shell and body; or, as is shown in the Figs., they may be joined only at the peripheral edge of the shell using a contact adhesive tape. The shell can be decorated by inks or pigments, as discussed more fully below and, to the extent the completed shell is opaque, it can hide surface irregularities and conceal the straps, giving the helmet a finished appearance.

More significantly from the standpoint of safety, the shell can serve to preserve the overall integrity of the helmet even after a portion of the body has been damaged by a first impact, so that the helmet remains in place on the wearer's head to provide continuing protection in the event of additional impacts that may occur as the crash develops.

Figure 12:
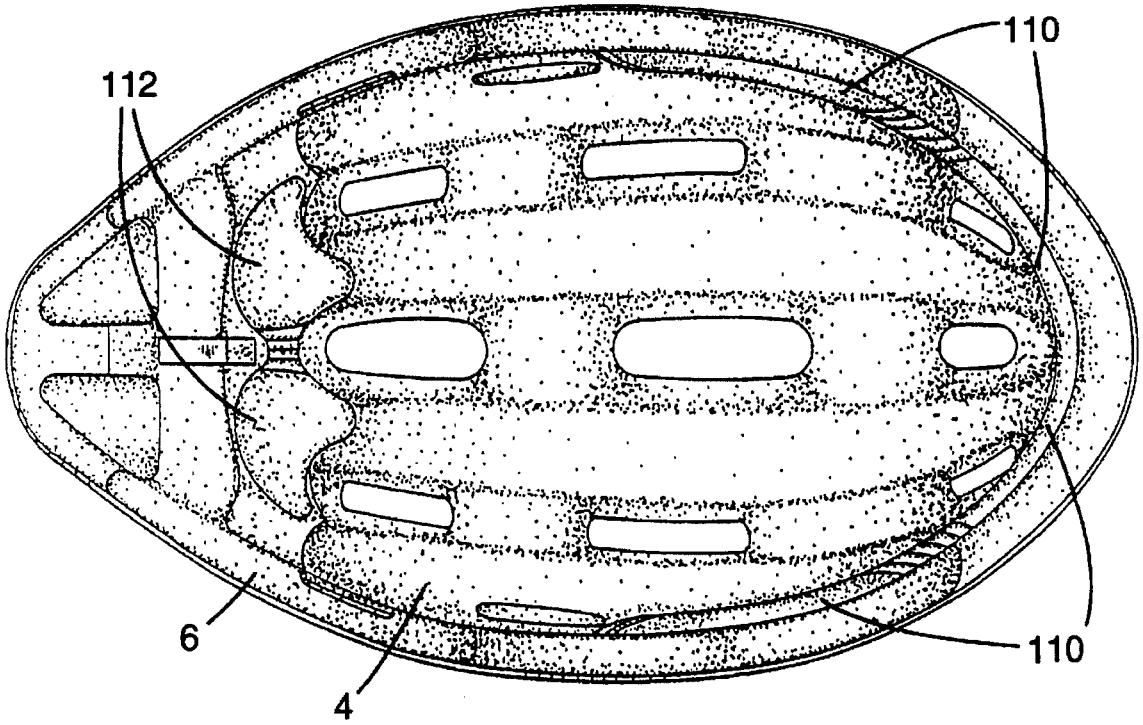
FIG. 12 is a sketch showing the embodiment of FIG. 7 viewed from below.
Figure 13:
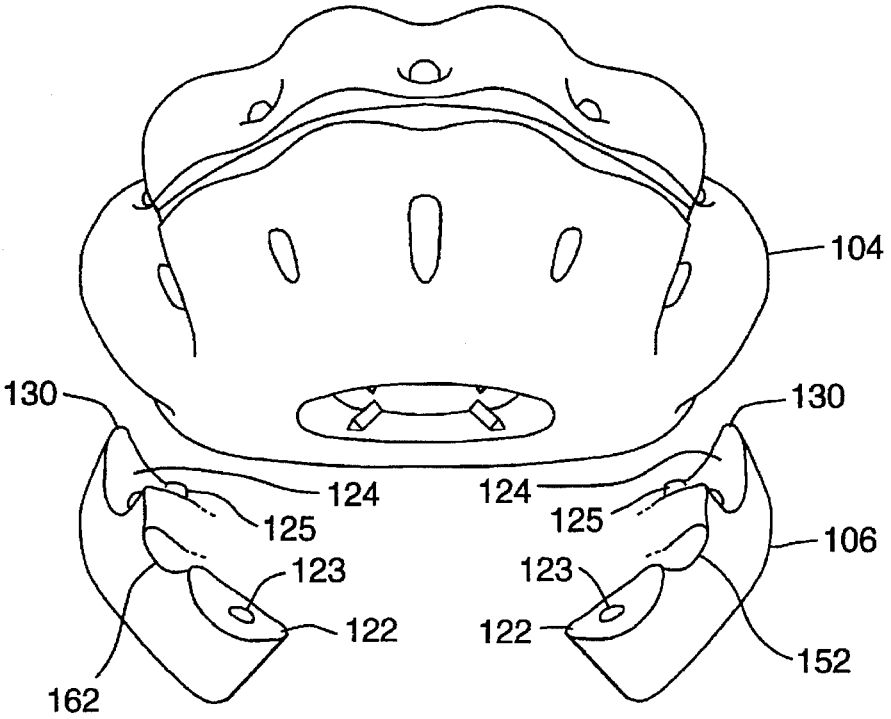
FIG. 13 is a sketch showing the helmet body of FIG. 1 in exploded front view.
Figure 14:
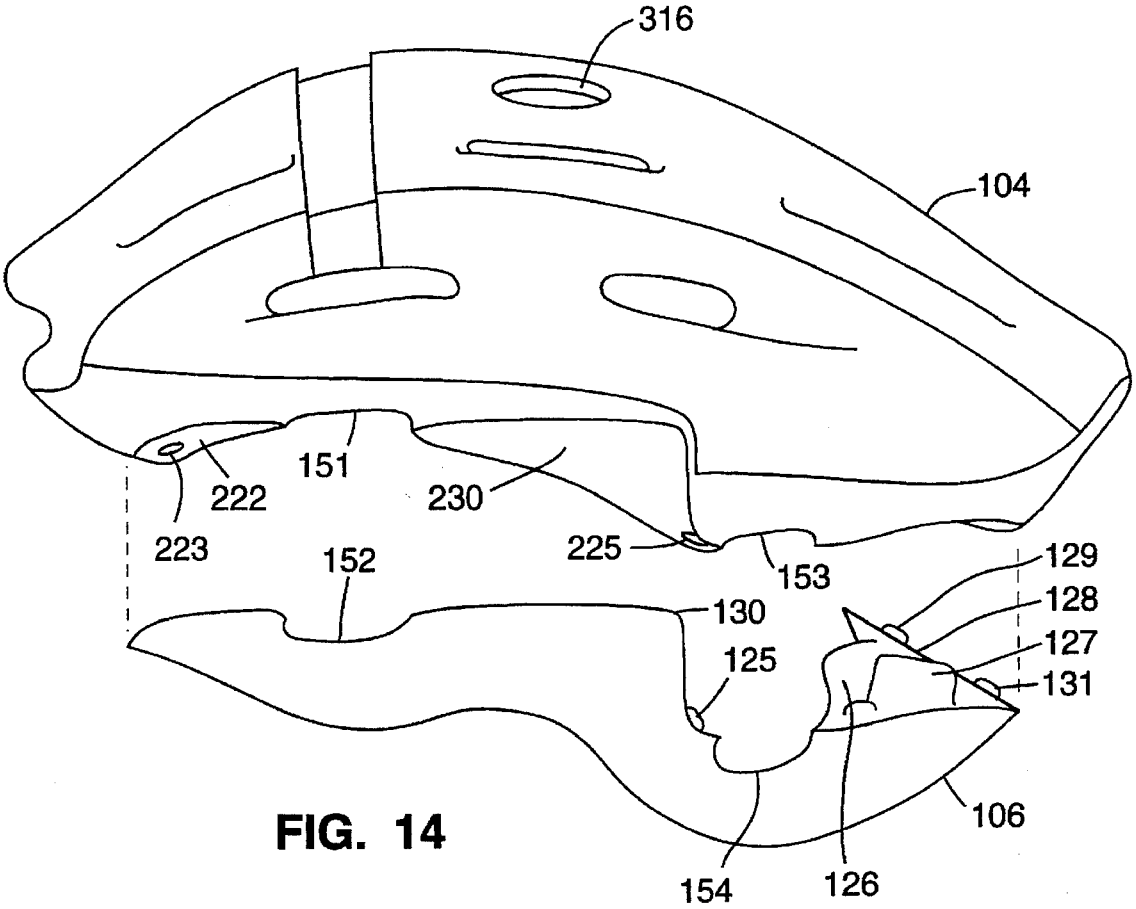
FIG. 14 is a sketch showing the helmet body of FIG. 1 in exploded side view.
Figure 15:
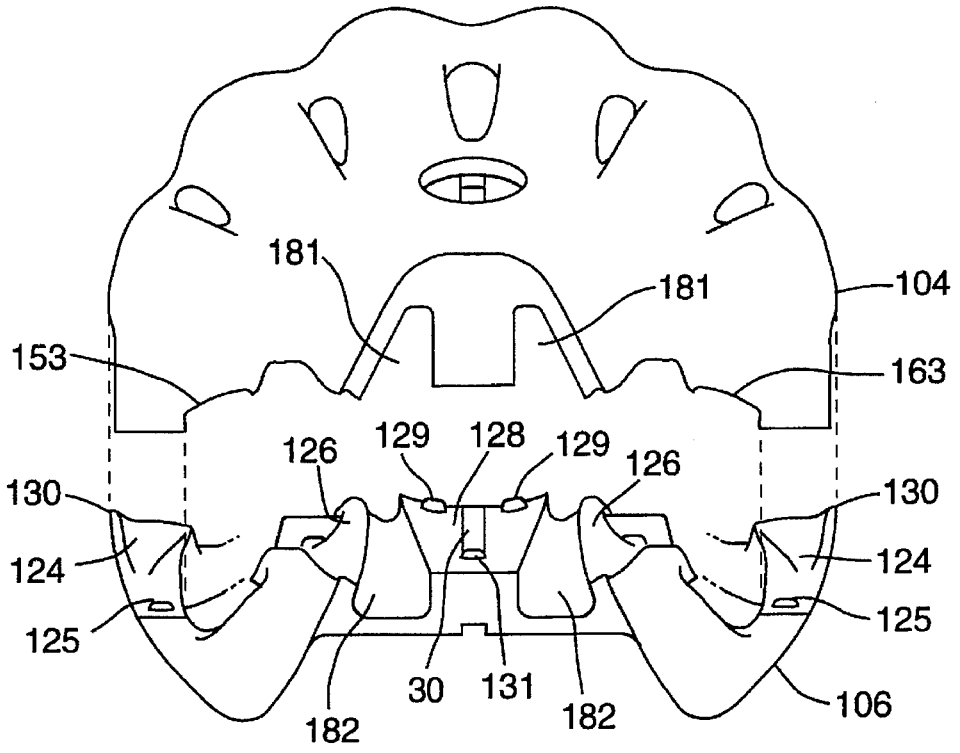
FIG. 15 is a sketch showing the helmet body of FIG. 1 in exploded rear view.
Figure 16:
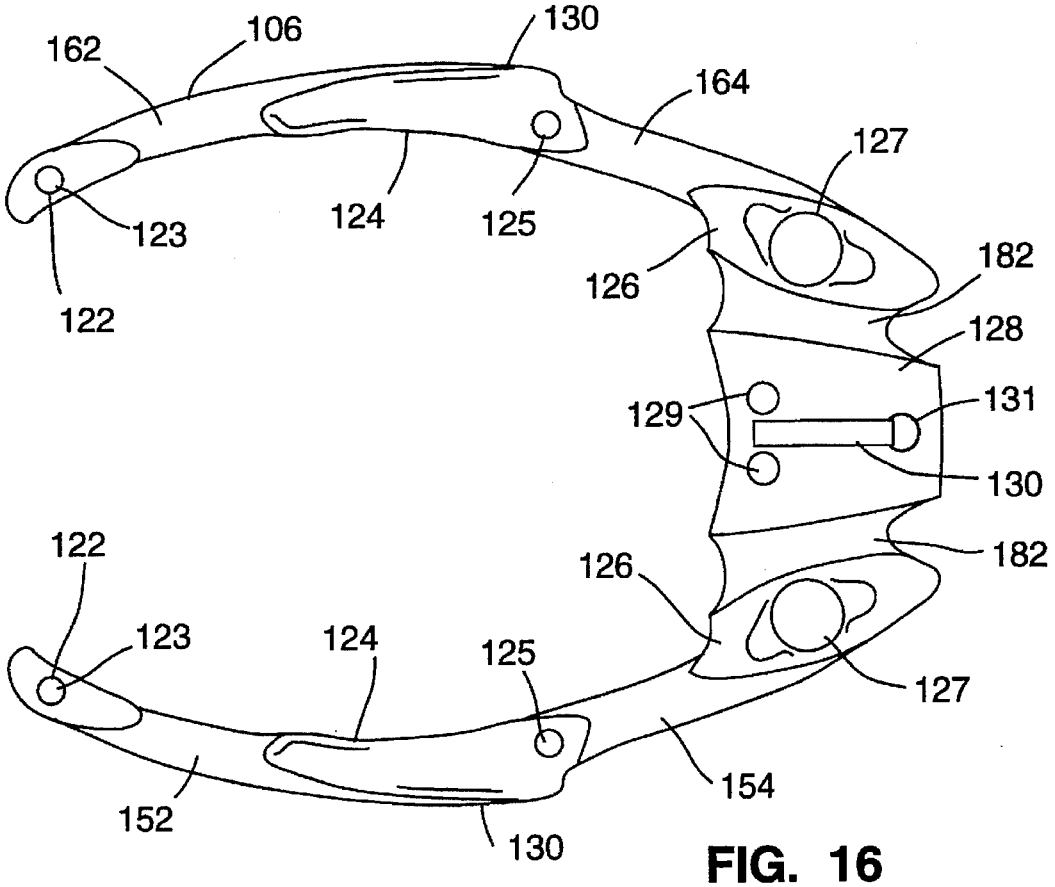
FIG. 16 is a sketch showing the lower part of the helmet body of FIG. 1 viewed from above.

A close fit of the helmet to the wearer's head is important for providing protection from impact. In preferred embodiments, pads are provided within the helmet to provide comfortable and stable points of contact of the helmet with the wearer's head. Referring now to FIG. 12, a rear pad 112 provides for a comfortable contact between the helmet and the midparietal region of the head, and a front pad 110 provides for a comfortable contact between the helmet and the frontal region of the head. These pads additionally have the effect of holding portions of the inner wall of the helmet slightly away from the skin of the head. Preferably the pads are a sandwich construction, filled with a soft resilient polymer layer, such as a polyether foam. They can be provided on the skin-contacting surface with a breathable material such as the material marketed by Malden Mills under the name Polartech™. The pads are preferably held in place in the helmet by hook-and-wool fasteners; such as are known generally under the tradename Velcro®. In that event the hook elements can be affixed using for example a pressure-sensitive adhesive at selected points in the helmet body, and the pads can be provided on the helmet-facing surface with, for example, a brushed nylon that adheres well to the hook elements.

Fabrication

Generally, as noted in the foregoing description, a bicycle helmet according to the invention can be fabricated using techniques known in the art. Bicycle helmets in various configurations are known that include, for example, a helmet body made of gas expanded synthetic polymer and covered with a thin shell shaped and cut to conform to a portion of the helmet body surface.

Fabrication of the helmet body.

Complex shapes can present particular problems for the person of ordinary skill in designing and tooling molds in the present art. Particularly in view of the fact that the preferred embodiments according to the invention are provided with openings through the helmet body wall (the various vents) that are oriented in various directions, there follows a fairly detailed description, with reference to FIGS. 13–18, of a mold configuration that may be particularly recommended.

Generally, the helmet body of the preferred embodiment is formed in two separate parts, and the parts are then adhesively bonded together at their mutually contacting surfaces. The mutually contacting surfaces are made complementary in shape, so that they meet closely when joined. One part 106 comprises much of the skirt portion 6 of the helmet body, and the other part 104 comprises much of the crown portion 4. The two parts are shown in exploded view in various orientations in FIGS. 13–15; and the skirt part 106 is shown alone in a view from above in FIG. 16.

With reference now to the Figs., skirt part 106 is generally horseshoe-shaped when viewed from above (FIG. 16), with the paired arms at the sides projecting toward the front. The respective contacting surfaces of skirt part 106 include paired front contacting surfaces 122, paired side contacting surfaces 124, paired rear contacting surfaces 126, and midline rear contacting surface 128. Front skirt part contacting surfaces 122 appose front crown part contacting surfaces 222, the left one of which is visible in FIG. 14. Side skirt part contacting surfaces 124 each include a flange portion 130; these appose complementary-formed side crown part contacting surfaces, of which a flange-apposing portion 230 is visible in FIG. 14. Paired rear skirt part contacting surfaces 126 appose complementary-formed paired rear crown part contacting surfaces, not shown in the Figs.; and midline rear skirt part contacting surface 128 apposes a complementary-formed midline rear crown part contacting surface, not shown in the Figs. Surface projections on the skirt part contacting surfaces closely match surface excavations on the crown part contacting surfaces; for example, roughly hemispherical bumps 123 and 125, located respectively on the front and side contacting surfaces, register closely with corresponding roughly hemispherical dimples 223 and 225, visible in FIG. 14. Roughly hemispherical bumps 129 (paired) and 131, located on midline rear skirt part contacting surface 128, also register closely with corresponding hemispherical dimples on the midline rear crown part contacting surface. Additionally, an elevated roughly cylindrical projection 127 on each paired rear skirt part contacting surface 126 closely fits a corresponding impression on each paired rear crown part contacting surface; projection 127 and the corresponding impression are formed at the site of injection of polymer resin beads during the molding process, as is described in greater detail below. As is shown most clearly in FIGS. 14 and 15, the parts 104 and 106 are joined on a line (or plane) that passes through vents 61, 71, 63, 73, and 80, so that when the parts are separated the crown part 104 forms (on the left side, for example) upper margins 151, 153, and 181 and the skirt part forms (on the left side, for example) lower margins 152, 154, and 182 of vents 71, 73, and 80, respectively. By this means, the skirt provides for extension downward of helmet material for protection along the sides and rear of the head, and additionally provides for venting at the sides and improved directive exit venting to the rear.

Each of parts 104, 106 is made of gas expanded polymer resin formed in a mold using generally known techniques. Briefly, each mold is made up of an assembly of two or more mold sections, or "pulls". The mold sections are brought together to form a hollow cavity having precisely the shape of the object to be formed; then, expandable polymer resin pellets are forced into the cavity, typically by means of a stream of air in which the beads are entrained; then the pellets in the cavity are exposed to heat, typically by forcefully injecting steam into the bead-filled cavity, causing the beads to expand to completely fill the cavity and to adhere to each other in a more or less continuous mass; then the pellets are allowed to harden and the pulls are drawn away from the formed surface. The result is a lightweight solid expanded polymer mass having a surface contour and texture that closely complements the inner walls of the assembled mold.

As is well appreciated in the tooler's art, the above-described method can present topological puzzles, for as the mass hardens each mold section must be capable of being drawn away from that portion of the mass whose surface it formed. For complex shapes—and particularly, for example, for shapes that enclose a space and that are perforated by openings that are oriented in various directions away from the enclosure—a fairly large number of pulls may be required. Generally, the greater the number of pulls, the more costly the mold is to construct and the more difficult it is to use. And the more complicated the shape, and the smaller and more tortuous the spaces within the mold cavity through and into which the beads must travel during loading of the mold, the more likely it is that failures may result.

Figure 17:
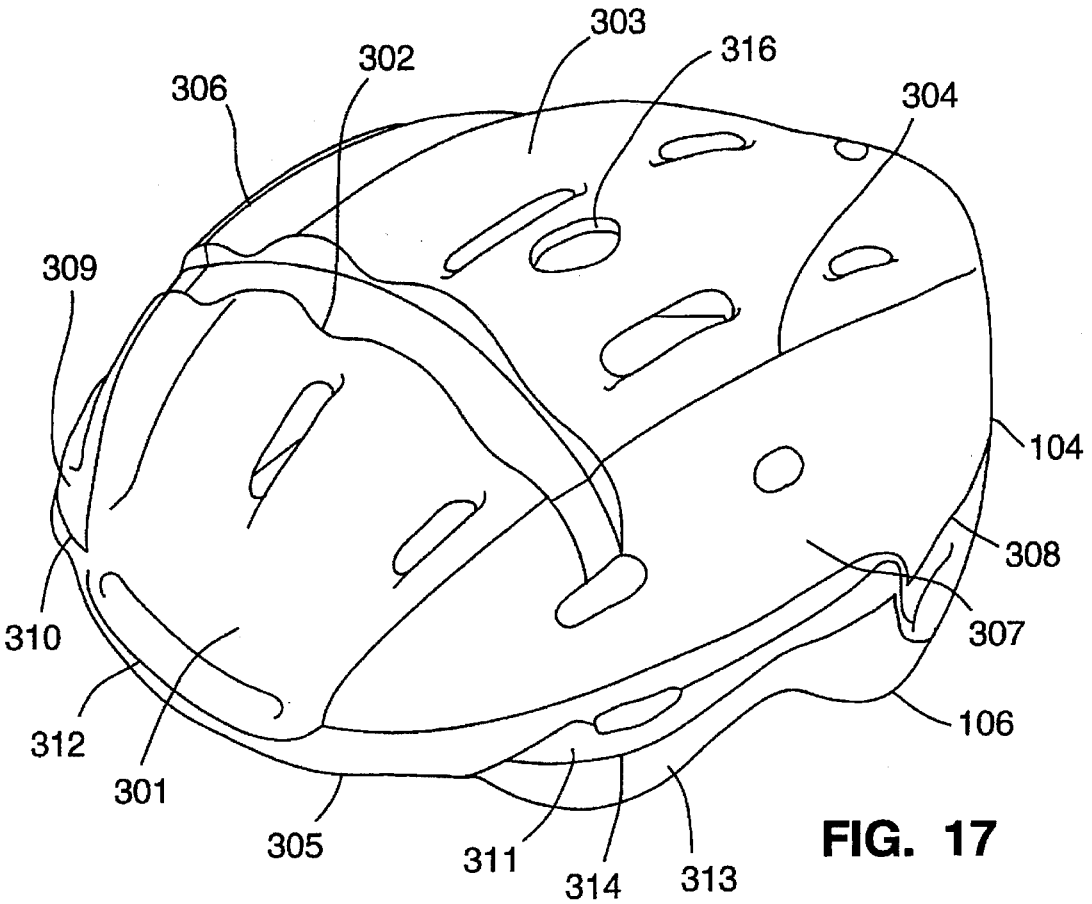
FIG. 17 is a sketch as in FIG. 1, showing relative positions of mold segments.
Figure 18:
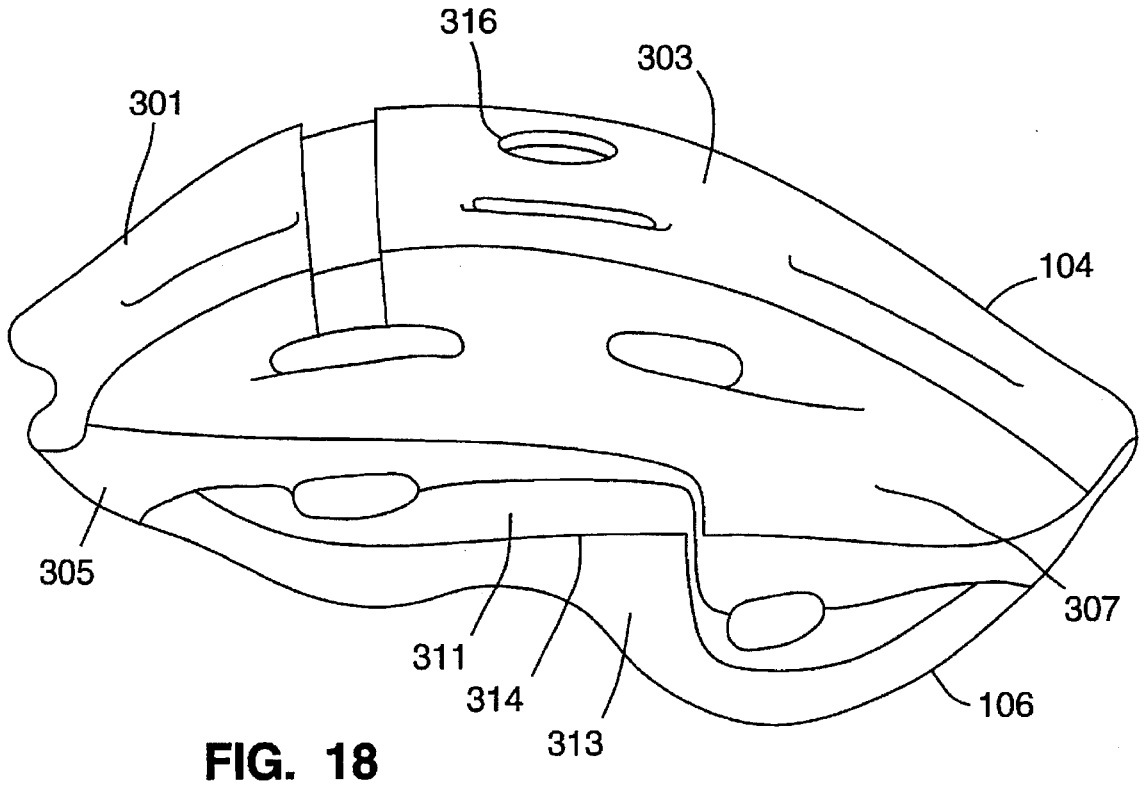
FIG. 18 is a sketch as in FIG. 3, showing relative positions of mold segments.

The helmet body according to the invention as described above with reference to FIGS. 1–6 can be formed in two parts as described above with reference to FIGS. 13–16 using a suitably arranged pull configuration as shown for example in FIGS. 17 and 18. In these Figs. lines representing the fine seams between adjacent pulls in the assembled mold (which may be testified to by fine raised lines on the surface of the completed helmet body) are shown dividing the helmet body surface into the various areas formed by the various pulls.

Crown part 104 can be formed by a front pull 301, top pull 303, side pulls 307, 309, and bottom pull 305 (which includes the inner surface of the crown part 104. Their boundaries are shown by mold lines 302 (which coincides with the upper edge of the front margin of transverse groove 20), 302, 304, 306, 308, 310, and 312. The various orientations of the vents and other features can be obtained by withdrawing the front pull roughly forward, the top pull upward and slightly rearward, the side pulls upward and away to the sides, and the bottom pull roughly downward. An impression 316 in the upper surface shows the position of the port through which the beads were injected in the molding process; two other ports for injection of beads into the crown are not shown in the Figs., but are situated in the paired rear contacting surfaces at positions corresponding to the positions of the injection ports for the skirt part 106 (see bead port elevation 127 in FIGS. 14, 15, 16).

Skirt part 106 can be formed by an upper pull 311 and a lower pull 313, separated by mold line 314, which are withdrawn respectively roughly upward and downward.

Expandable polystyrene ("EPS") is a preferred expandable polymer for use in forming the helmet body according to the invention; such polymers are commercially available, marketed for example by General Electric Company under the name GE-CET. Other gas expandable polymers may alternatively be used, as, for example, expandable polypropylene or urethane.

Fabrication of the shell.

In helmet embodiments that are provided with a shell, as shown for example in FIGS. 7–12, the shell preferably is made from sheetstock of a thermoformable polymer such as a polyester teraphthylate glycol ("PETG"). Fabrication is straightforward. A form is provided, having a surface configuration corresponding to the shape of the helmet body portion to be covered by the shell. Vacuum means are used to draw a sheet of the polymer tightly onto the form, which is then heated to set the polymer in the conforming shape. The formed polymer piece is then trimmed to form its peripheral edge 103, and the vents are cut out to form edges (101, for example). The resulting trimmed and cut shell is then pulled over the completed helmet body 2, which it closely fits, and the shell edge is taped onto the periphery of the helmet body 2 using an elastic tape 102 such as a vinyl tape having a pressure sensitive adhesive.

Preferred shell materials, such as PETG, readily take any of a variety of inks or other pigments, and so can be used to provide a decorative finish. Preferably, an inked or otherwise pigmented design is printed on the back surface of the sheet (that is, on the surface that will face the helmet body when the shell is in place), providing for a glossy outer surface in the resulting product, and avoiding wear of the design.

Other thermoformable polymers than PETG can be used for the shell, and other polymers such as thermoset polymers can be used.

Other Embodiments

Other embodiments are within the following claims and, as will be appreciated, substantial variation in configuration can be made, all within the invention. The embodiments shown in the Figs. are presented by way of examples, and they are meant to be illustrative of an actual embodiment of the invention. Consequently, and as will be appreciated, the particular configurations of some features shown in the Figs. were selected as having substantial ornamental appeal.

For example, the front intake vent can have a shape and/or dimensions substantially different from that shown in the examples. According to the invention, however, the front intake vent should be situated very low in front, so as to provide a flow of oncoming air low onto the wearer's forehead, and should be wider than high, so as to provide broad distribution of the air over and around the frontal portion of the head beneath the helmet. As explained above, preferably a pair of lengthwise inner channels spaced apart from the midline of the helmet draws inflowing air from the front intake vent rearward, and for this purpose the forward ends of the channels preferably meets or reaches close to the side margins of the inner opening of the front vent.

The front vent tapers from the outside surface to the inside surface of the front helmet body wall. Although no fixed dimensions are required for the front vent, the width of the front vent at the opening to the outer surface of the helmet body is preferably at least about one-third, and preferably at least about one-half, of the transverse width between the inner walls of the helmet body at its widest point; and the width of the front vent at the opening to the inner surface of the helmet body is preferably at least about one-fourth, and preferably at least about one-third, of the transverse width between the inner walls of the helmet body at its widest point. In one standard helmet size, the widest inner diameter is about six inches, and the front vent for such a helmet preferably would taper (front-to-rear) from an outside width of at least about two inches and preferably at least about three inches to an inside width of at least about one and one-half inches to at least about two inches.

The front vent preferably is situated such that it opens as low on the forehead as possible, without unduly structurally compromising the front lower margin of the helmet body. Using materials as set out in the detailed description above, a helmet having a configuration as shown for example in FIG. 4 displayed sufficient strength is an industry standard test where the vertical thickness of the helmet portion was about five-eights inch at the inner helmet body wall below the front vent.

As will be appreciated, the front vent according to the invention may be provided with a vertical partition; preferably, however, midline obstruction of the flow of oncoming air is minimized or avoided according to the invention.

The number and arrangement of various of the vents can be altered substantially. For example, the illustrative examples have three valleys, each having a series of three vents, and two additional valleys, each having a air of vents. Fewer valleys may be provided than are shown; and fewer vents may be provided in each valley than are shown. Particularly, the midline valley may be eliminated, and the others (or two or more of them, or some variant of them) may be retained; in this event, each of the valleys on either side of the midline may be provided within the helmet with a channel as described above for drawing air rearward from the front intake port.

As noted above, the rear exit ports, if present, may alternatively be formed as a single port at the midline; paired exit ports situated near the midline are preferred, however, as that arrangement accommodates the rear strap slot, which is situated at the midline. Moreover, as will be apparent from the discussion above of their function, the rear exit ports can help to draw air within the helmet rearward over the head, and positioning the rear exit ports at some distance apart from the midline can widen their influence on air flow nearer the front. Preferably, the rear exit ports are enclosed both above and below, as provided respectively by the crown portion and the skirt portion, respectively, as discussed below.

The rear exit ports taper from the outside surface to the inside surface of the rear helmet wall. As for the front vent, no fixed dimensions are required for the rear exit ports. Configuration according to the invention, however, provides for substantially large rear exit ports without undue compromise of the structure of the helmet body. The opening of each rear port to the inner surface of the helmet is preferably about circular, and has a diameter preferably at least about one-half and preferably at least about five-eights inch.

I claim:

1. A bicycle helmet, comprising a helmet body having a plurality of longitudinally extending valleys on the surface thereof, the valleys extending continuously from a front portion of the helmet body to a rear portion of the helmet body, the valleys having at least two longitudinally elongated vents therethrough, a transversely extending front vent that is wider than high, the front vent is located at the most forward margin of the helmet body below the most forward point of the longitudinally extending valleys so that oncoming air is directed onto and over the user's forehead; and helmet retention means for securing the helmet to a user's head.

2. The bicycle helmet of claim 1 further comprising at least one lower vent located in a depression rearward and above the user's ear.

3. The bicycle helmet of claim 1 wherein the helmet body comprises a crown member having contacting surfaces around a lower periphery and a skirt member having mating surfaces for mating with the contacting surfaces of the crown member, the skirt member provides an extension downward for protecting along the sides and rear of the user's head.

4. The bicycle helmet of claim 1 further comprising at least one rear exit port opening outward through a surface of the helmet body that is below the most rearward margin of the helmet body.

5. The bicycle helmet of claim 1 further comprising a shell shaped to conform to the outer surface of at least part of the helmet body such that the periphery of the shell traces the largest perimeter of the helmet body and a portion of the shell that conforms to the valleys extends at least partially down the sides of the valleys into the vents.

6. A bicycle helmet, comprising a helmet body having a plurality of longitudinally extending valleys on the surface thereof, the valleys extending continuously from a front portion of the helmet body to a rear portion of the helmet body, the valleys having at least two longitudinally elongated vents therethrough, a transversely extending front vent that is wider than high located below the most forward point of the longitudinally extending valleys, at least one rear exit port opening outward through a surface of the helmet body that is below the most rearward margin of the helmet body so that air is directed through the front vent and the elongated vents over the user's head and out through the exit port opening; and helmet retention means for securing the helmet to a user's head.

7. A bicycle helmet, comprising:

a helmet body having a crown member having contacting surfaces around a lower periphery extending across the thickness of the crown member and a forward hemi-elliptical recess near the front of the crown member, and a skirt member having mating surfaces extending across the thickness of the skirt member and a forward hemi-elliptical recess near the front of the skirt member corresponding to the forward hemi-elliptical recess of the crown member so that the forward hemi-elliptical recesses form a side vent forward and above a user's ear when the crown member contacting surfaces are mated with the contacting surfaces of the crown member, the skirt member provides an extension downward for protecting along the sides and rear of the user's head; and helmet retention means for securing the helmet to the user's head.

8. A bicycle helmet, comprising:

a helmet body having a crown member having contacting surfaces around a lower periphery extending across the thickness of the crown member and a rear hemi-elliptical recess near the rear of the crown member, and a skirt member having mating surfaces extending across the thickness of the skirt member and a rear hemi-elliptical recess near the rear of the skirt member corresponding to the rear hemi-elliptical recess of the crown member so that the hemi-elliptical recesses form a rear exit port of the helmet body when the crown member and skirt member are mated together, the skirt member provides an extension downward for protecting along the sides and rear of a user's head; and helmet retention means for securing the helmet to the user's head.

9. A bicycle helmet, comprising:

a crown member having contacting surfaces around a lower periphery and a forward hemi-elliptical recess near the front of the crown member; and a skirt member having mating surfaces for mating with the contacting surfaces of the crown member and a forward hemi-elliptical recess near the front of the skirt member corresponding to the forward hemi-elliptical recess of the crown member so that the forward hemi-elliptical recesses form a side vent forward and above the user's ear when the crown member and skirt member are mated together, the skirt member provides an extension downward for protecting along the sides and rear of the user's head; and helmet retention means for securing the helmet to a user's head.

10. A bicycle helmet, comprising:

a crown member having contacting surfaces around a lower periphery and a rear hemi-elliptical recess near the rear of the crown member;

a skirt member having mating surfaces for mating with the contacting surfaces of the crown member and a rear hemi-elliptical recess near the rear of the skirt member corresponding to the rear hemi-elliptical recess of the crown member so that the hemi-elliptical recesses form a rear exit port of the helmet body when the crown member and skirt member are mated together, the skirt member provides an extension downward for protecting along the sides and rear of the user's head; and helmet retention means for securing the helmet to a user's head.

* * * * *

UNITED STATES PATENT AND TRADEMARK OFFICE

CERTIFICATE OF CORRECTION

PATENT NO 5,651,145

DATED July 29, 1997

INVENTOR(S) F Robert Egger

Column 2, line 10, "front" should be --rear--

Column 2, line 14, "rear" should be --front--

Column 2, line 23, "front" should be --rear--

Column 2, lines 26 and 27, "in a rear view" should be --viewed from above--.

Column 2, line 29, "viewed from above" should be --in a front view--

Column 4, line 37, "20" should be --30--

Column 4, line 39, "20" should be --30--

Column 4, line 44, "20" should be, both occurrences, --30--

Signed and Sealed this

Third Day of February, 1998

*Attest:*

Bruce Lehman

BRUCE LEHMAN

*Attesting Officer*

*Commissioner of Patents and Trademarks*